United States Patent [19]

Clark et al.

[11] 4,080,035

[45] Mar. 21, 1978

[54] STRAIN RELIEF DEVICE

[75] Inventors: Richard Paul Clark, Hershey; Brian Alfred Wolfe, Grantville, both of Pa.

[73] Assignee: AMP Incorporated, Harrisburg, Pa.

[21] Appl. No.: 787,188

[22] Filed: Apr. 13, 1977

[51] Int. Cl.[2] ..... H01R 13/58

[52] U.S. Cl. ..... 339/103 M; 24/16 PB; 339/176 M

[58] Field of Search ..... 339/103 M, 103 R, 104, 339/107, 176 M; 24/16 PB; 140/123.6

[56] References Cited

U.S. PATENT DOCUMENTS

| | | | |
|---|---|---|---|
| 3,694,863 | 10/1972 | Wasserlein, Jr. | 24/16 PB |
| 3,699,502 | 10/1972 | Carter | 339/176 M |
| 3,732,526 | 5/1973 | Punako | 339/103 R X |
| 3,830,263 | 8/1974 | Benfer | 140/123.6 X |
| 3,904,265 | 9/1975 | Hollyday et al. | 339/103 M |
| 3,964,133 | 6/1976 | Wasserlein, Jr. | 24/16 PB |

*Primary Examiner*—Roy Lake
*Assistant Examiner*—DeWalden W. Jones
*Attorney, Agent, or Firm*—Russell J. Egan

[57] ABSTRACT

An improved strain relief device is disclosed for permanent attachment to known electrical connector housings. The subject strain relief device allows for simple tie down of the conductors leading to the connector in either angled or in-line configurations.

3 Claims, 4 Drawing Figures

STRAIN RELIEF DEVICE

BACKGROUND OF THE INVENTION

1. The Field of the Invention

The present invention relates to an improved strain relief device to be permanently attached to a conventional multi-contact electrical housing.

2. The Prior Art

There is frequently the need to provide strain relief for the conductors fed to an electrical connector. Such a requirement is necessitated by the fact that many times the technicians working on equipment are prone to grab the conductors and pull to remove a connector rather than to grasp the connector itself. Such an occurrence can result in damage to the connector by either removing the conductors from the contacts or even pulling the contacts from the connector.

To solve this problem it has been the accepted means in the industry to provide strain relief housings which are clamped on the connector housing itself by some known fashion such as screws and the like. The known strain relief devices are frequently large and cumbersome and take up a great deal of space which is not always available. An example of a known strain relief housing that is clamped on a connector may be found in U.S. Pat. No. 3,904,265.

SUMMARY OF THE INVENTION

The present invention is a strain relief device to be permanently assembled with a known electrical connector, preferably by ultrasonic bonding or the like. The subject strain relief device is a substantially flat sheet of rigid plastics material having a regular geometric configuration. On one surface of the sheet are three V-shaped conductor gathering means arranged to form a block letter C opening towards the connector housing. Four apertures are formed in the sheet each aligned with and spaced from an end of a V-shaped gathering means. Arcuate gripping indentations are formed in the side edges of the sheet adjacent the connector.

It is therefore an object of the present invention to overcome the difficulties of the prior art by providing a thin and inexpensive strain relief device which can be assembled with any known electrical connector, such as the connector illustrated in U.S. Pat. No. 3,699,502.

It is a further object of the present invention to produce a strain relief assembly which can be readily and economically manufactured.

The means for accomplishing the foregoing objects and other advantages will become apparent to those skilled in the art from the following detailed description taken with reference to the accompanying drawings.

BRIEF DESCRIPTION OF THE PREFERRED EMBODIMENT

Figure 1:
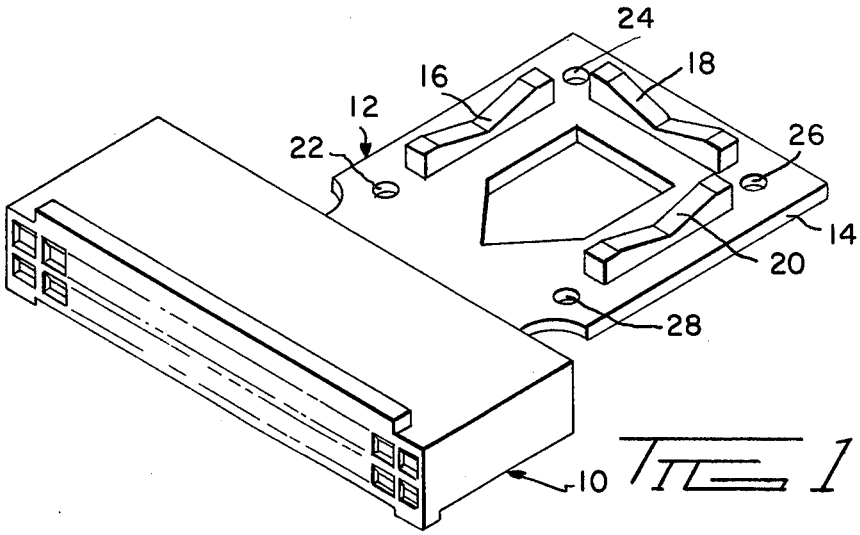
FIG. 1 is a perspective view of the subject invention engaged with an electrical connector of known configuration.

The electrical connector 10 shown in the drawings is of a known and conventional type, such as the connector described in U.S. Pat. No. 3,699,502.

The subject strain relief 12 is formed of a rigid sheet 14 of plastics material and has a regular geometric configuration. Three V-shaped conductor gathering members 16, 18, 20 integrally extend from one surface of the sheet forming a block letter "C" opening towards the connector. A plurality of apertures 22, 24, 26, and 28 are formed in the sheet 14, each spaced from an end of and aligned with at least one of the cable gathering members 16, 18, 20. The subject strain relief means also includes a flange 30 which is ultrasonically bonded to the connector 10 at points 32, 34. A pair of arcuate recesses 36, 38 in the opposite side edges of the sheet 14 serve as finger grips to assist in removing the connector.

Figure 2:
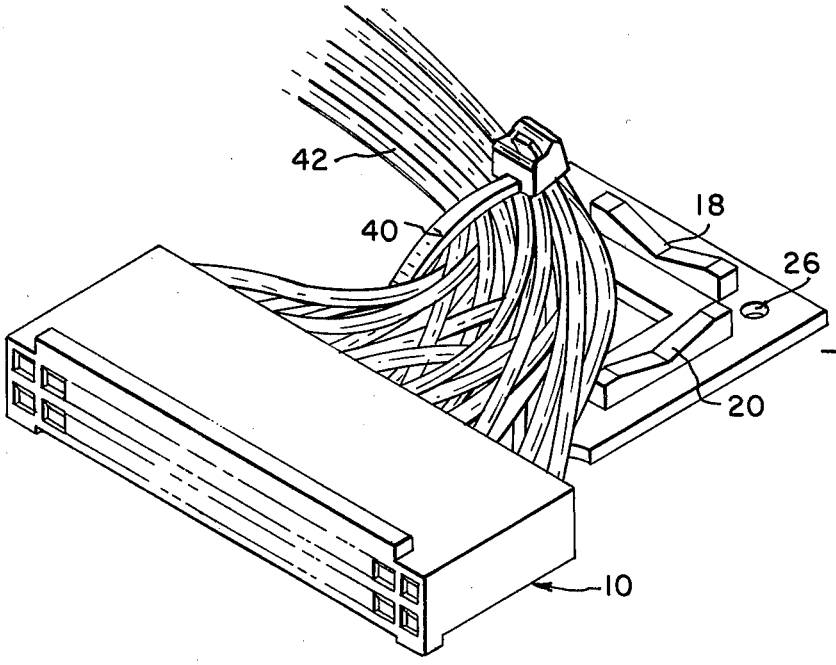
FIG. 2 is similar to FIG. 1 showing a plurality of conductors secured to the subject strain relief.
Figure 3:
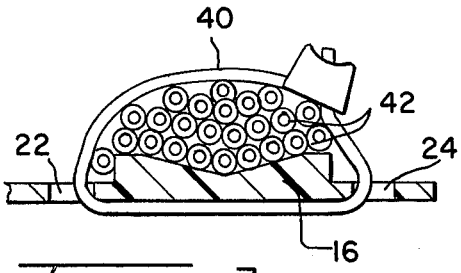
FIG. 3 is a section view taken along line 3—3 of FIG. 2.
Figure 4:
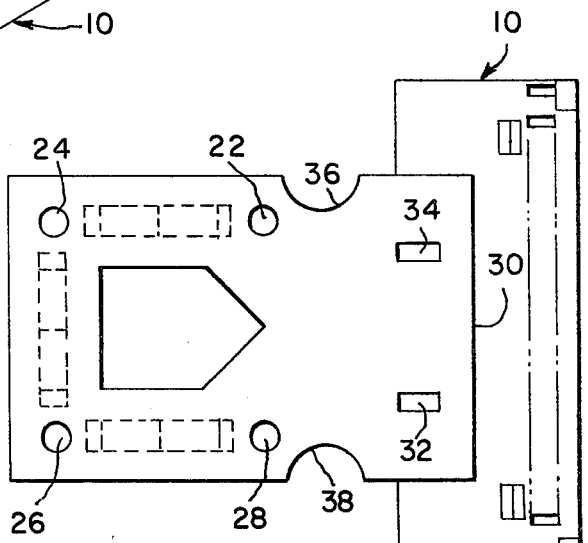
FIG. 4 is a bottom plan view of the subject strain relief device secured to a connector housing.

The assembly is utilized with a known cable tie means 40, for example, the ties described in U.S. Pat. Nos. 3,694,863 and 3,964,133. The tie 40 is shown in FIG. 2 passing through apertures 22, 24 to secure the conductors 42 dressed in the gathering member 16 to the strain relief device 12. It should be noted that with this invention that it would be possible to dress the cables extending 180° from one another going in opposite directions parallel to the connector. It is also possible to dress the cables going straight out from the connector or to either side.

The cable tie 40 can be applied by any of the well known tie applicator tools such as those described in U.S. Pat. Nos. 3,810,499 and 3,830,263.

The present invention may be subject to many modifications and changes without departing from the spirit or essential characteristics thereof. The present embodiment is therefore to be considered in all respects as being illustrative and not restrictive of the scope of the invention.

What is claimed is:

1. A strain relief means for permanent attachment to an electrical connector housing, said strain relief means comprising:

a rigid sheet of insulating material having a generally rectangular configuration, three profiled conductor gathering members integrally extending from a first surface of said sheet, each said member aligned parallel to a respective side of said sheet defining a block letter C opening towards a fourth side of said sheet, at least one aperture in said sheet aligned with and spaced from each end of each conductor gathering member, means on said fourth side to secure said sheet permanently to an electrical connector housing, and bundle tie means passed through a pair of said apertures at opposite ends of a conductor gathering member whereby conductors of said connector are secured in a conductor gathering member.

2. A strain relief means according to claim 1 further comprising:

gripping recesses in the sides of said sheet extending from said fourth side.

3. A strain relief means according to claim 1 wherein each said conductor gathering member includes a pair of inclined surfaces forming a V-shape opening towards the adjacent side.

* * * * *